US005183955A

United States Patent [19]

Calabrese et al.

[11] Patent Number: 5,183,955

[45] Date of Patent: Feb. 2, 1993

[54] PIANO KEY COVERS FORMED OF IVORY SUBSTITUTE AND PIANOS HAVING SAME

[75] Inventors: Salvadore J. Calabrese, Clifton Park; Henry A. Scarton, Troy; S. Frank Murray, Clifton Park; Christopher M. Ettles, Glenmont; Warren C. Kennedy, Feura Bush; Saim Dinc; Bessem Jlidi, both of Troy, all of N.Y.; William Strong, Stamford, Conn.

[73] Assignees: Renselaer Polytechnic Institute, Troy, N.Y.; Steinway Musical Properties, Inc., Waltham, Mass.

[21] Appl. No.: 525,468

[22] Filed: May 18, 1990

[51] Int. Cl.[5] ..... G10C 3/12

[52] U.S. Cl. ..... 84/437; 84/452 P

[58] Field of Search ..... 84/437, 438, 439, 452 P, 84/433

[56] References Cited

U.S. PATENT DOCUMENTS

| | | | |
|---|---|---|---|
| 174,000 | 2/1976 | Pratt | 84/437 |
| 271,120 | 1/1983 | Rikeman | 84/437 |
| 2,844,065 | 7/1958 | Corwin | 84/438 |
| 3,031,910 | 5/1962 | Lofaro | 84/453 |
| 3,032,455 | 5/1962 | Fauser | 84/437 |
| 3,060,074 | 10/1962 | Good | 84/438 |
| 4,346,639 | 8/1982 | Vagias | 84/437 |
| 4,419,921 | 12/1983 | Simanski | 84/467 |
| 4,840,104 | 6/1989 | Ishida et al. | 84/437 |

FOREIGN PATENT DOCUMENTS 2446519 4/1976 Fed. Rep. of Germany .

*Primary Examiner*—Michael L. Gellner
*Assistant Examiner*—Cassandra Spyrou
*Attorney, Agent, or Firm*—Fish & Richardson

[57] ABSTRACT

A piano key cover is formed of synthetic material pigmented to resemble natural ivory and having a top playing surface with a random orientation of peak-to-valley texture and a multiplicity of fine pores replicating natural ivory. The key cover is formed by providing a mold, engraving a surface of the mold with a randomly-oriented pattern of peak-to-valley texture replicating natural ivory, placing in the mold a composition of suitable synthetic material pigmented to resemble natural ivory and filler, the filler having the characteristic of being removable from a molded article by further treatment, forming the piano key cover within the mold, and treating the piano key cover to remove the filler thereby causing the surface of the paino key cover to define a plurality of fine pores replicating the surface of natural ivory. A piano including the key cover of the invention, and formed by the above method, is also described.

10 Claims, 1 Drawing Sheet

PIANO KEY COVERS FORMED OF IVORY SUBSTITUTE AND PIANOS HAVING SAME

BACKGROUND OF THE INVENTION

The invention relates to piano key covers and the like formed of synthetic ivory substitute material.

It has been the practice, for centuries, to manufacture piano key covers from natural ivory. In more recent years, initially due to concerns of cost and more recently due to concerns of wildlife conservation, it has been proposed to substitute synthetic plastic materials which have the appearance of natural ivory, see, e.g., Ishida U.S. Pat. No. 4,840,104 and Vagia U.S. Pat. No. 4,346,639. However, it has been found by experienced pianists that the feel of piano key covers of natural ivory differs significantly from that of key covers formed of synthetic materials, and that the quality of their performance on pianos having key covers of synthetic material is perceptibly diminished.

SUMMARY OF THE INVENTION

According to one aspect of the invention, a piano key cover is formed of a synthetic material pigmented to resemble natural ivory and has a top playing surface with a random orientation of peak-to-valley texture and a multiplicity of fine pores replicating that of natural ivory.

Preferred embodiments of this aspect of the invention may include one or more of the following features. A multiplicity of the pores have diameters generally in the range of 0.0002 to 0.0012 inch. The synthetic material is selected from the group consisting of silicone rubber (RTV), acrylic polymer, acetate polymer and epoxy.

According to another aspect of the invention, a piano key cover of synthetic material is formed by the method comprising providing a mold for a piano key cover, engraving a surface of the mold with a randomly-oriented pattern of peak-to-valley texture replicating that characteristic of natural ivory, placing in the mold a composition comprising a suitable synthetic material pigmented to resemble natural ivory and a filler, the filler having the characteristic of being removable from a molded article by further treatment, forming a piano key cover within the mold, and treating the piano key cover to remove the filler thereby causing the surface of the piano key cover to define a plurality of fine pores, replicating the surface of natural ivory.

Preferred embodiments of this aspect of the invention may include one or more of the following features. The filler comprises polyethylene glycol (PEG), preferably having a particle size of about 1 micron. A multiplicity of the pores have diameters generally in the range of 0.0002 to 0.0012 inch. The synthetic material is selected from the group consisting of silicone rubber (RTV), acrylic polymer, acetate polymer and epoxy.

According to other aspects of the invention, a piano comprises a piano key cover as described above, and may be formed generally according to the method described, with the additional steps of thereafter mounting the piano key cover upon a key board base and assembling the piano.

The objectives of the invention include providing a synthetic material for piano key covers which has the appearance and the feel of natural ivory, even to experienced pianists. The objectives also include providing a method for forming a piano key cover of the invention, and providing a piano having the key cover and formed according to the invention.

These and other features and advantages of the invention will be see from the following description of a presently preferred embodiment, and from the claims.

DESCRIPTION OF PRESENTLY PREFERRED EMBODIMENT

We first briefly describe the drawings.

Figure 1:
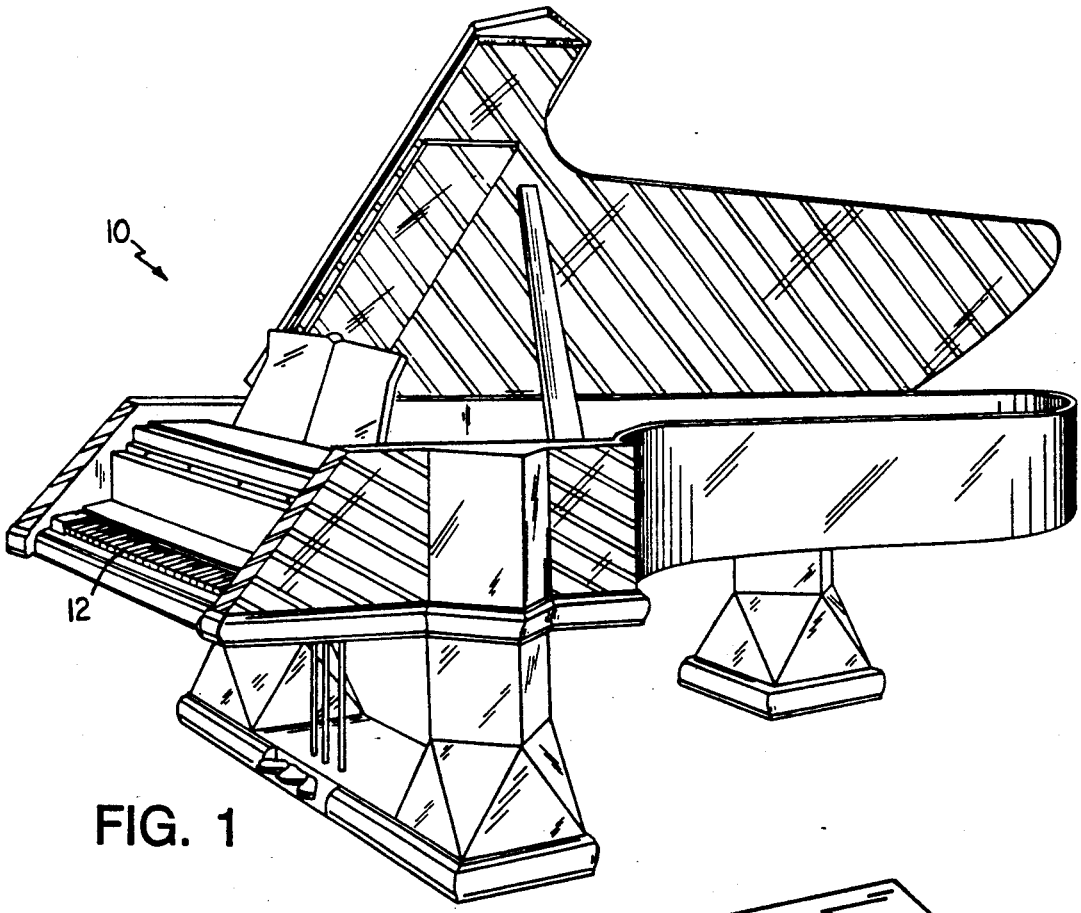
FIG. 1 is a perspective view of a grand piano having piano key covers of the invention.

Referring to FIG. 1, there is shown a grand piano 10 having piano keys 12 with piano key covers 14 of the invention.

Figure 2:
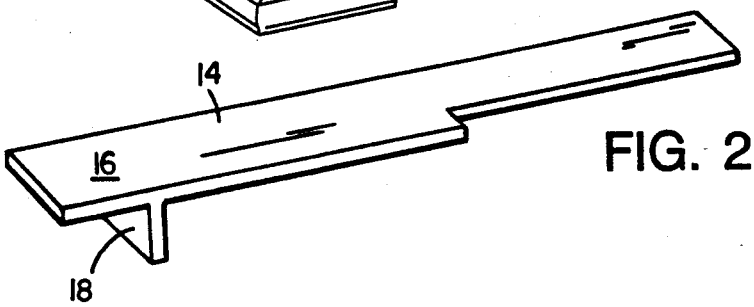
FIG. 2 is an enlarged perspective view of a piano key covers of the invention.

Referring also to FIG. 2, a piano key cover 14 includes a top surface 16 and a front surface 18, and is sized and constructed to be fixed upon a keyboard base (not shown), formed, e.g. of wood.

The piano key covers 14 of the invention are formed of a suitable synthetic molding material, e.g., silicone rubber (RTV), acrylic, acetate or epoxy, pigmented, e.g. with titanium dioxide ($TiO_2$), calcium oxide (CaO) and/or aluminum oxide ($A1_2O_3$), to duplicate the color and appearance of natural ivory.

Figure 3:
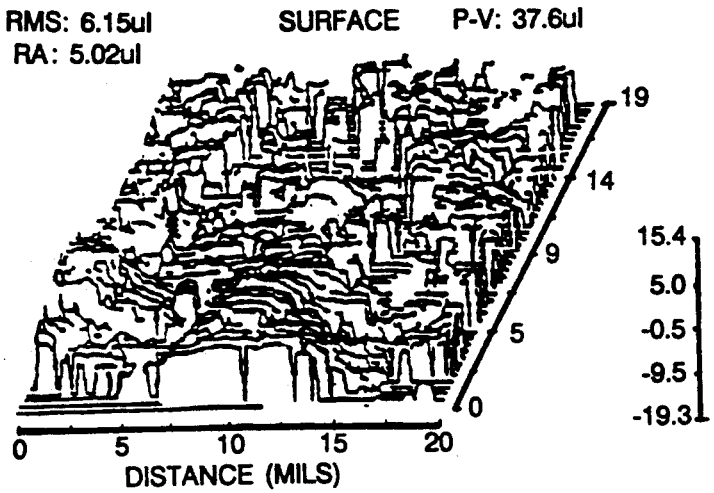
FIG. 3 is a three dimensional plot of surface texture for a sample of natural ivory.

According to the invention, the surface of the mold for forming the top surface 16 of the key cover is micro-engraved by known procedures to reproduce the random orientation of surface peak-to-valley texture that is characteristic of natural ivory, as seen in the three dimensional plot of surface texture for a sample of natural ivory (FIG. 3). A molding compound is prepared of a suitable material as described above, pigmented to match natural ivory, and containing a filler material to be described below.

The molding compound is placed in the mold and a piano key cover 14 of the invention is formed by standard molding techniques. The key cover is thereafter treated, e.g. by heating or solvent, as appropriate, to cause the filler material to be removed from the body of the piano key cover, leaving a plurality of micro-pores in the surface 16 of the key cover, replicating the large quantity of fine pores, typically between 0.0002 and 0.0012 inch diameter, found in natural ivory. Any suitable filler material may be employed, an example of which is polyethylene glycol (PEG), having a particle size of about 1 micron.

The molded piano key cover 14 of the invention may then be mounted upon a key board base for assembly in a piano 10.

Other embodiment of the invention are within the following claims.

What is claimed is:

1. A piano key cover of synthetic material formed by a method comprising:

providing a mold for a piano key cover, engraving a surface of said mold with a randomly oriented pattern of peak-to-valley texture replicating that characteristic of a surface of natural ivory, placing in the mold a composition comprising suitable synthetic material pigmented to resemble natural ivory and filler, said filler being removable from a molded article by further treatment, forming a piano key cover within said mold, said piano key cover having a surface, and treating said piano key cover to remove said filler thereby causing said surface of said piano key cover to define a plurality of fine pores, replicating the surface of natural ivory.

2. The method of claim 1 wherein said filler comprises polyethylene glycol (PEG).

3. The method of claim 2 wherein said PEG filler has a particle size of about 1 micron.

4. The method of claim 1 wherein many of the pores comprising said plurality of fine pores have diameters generally in a range of 0.0002 to 0.0012 inch.

5. The method of claim 1 wherein said synthetic material is selected from the group consisting of silicone rubber (RTV), acrylic polymer, acetate polymer and epoxy.

6. A piano having piano key cover of synthetic material formed by a method comprising:

providing a mold for a piano key cover, engraving a surface of said mold with a randomly-oriented pattern of peak-to-valley texture replicating that characteristic of a surface of natural ivory, placing in the mold a composition comprising suitable synthetic material pigmented to resemble natural ivory and filler, said filler being removable from a molded article by further treatment, forming a piano key cover within said mold, said piano key cover having a surface, treating said piano key cover to remove said filler thereby causing said surface of said piano key cover to define a plurality of fine pores, replicating the surface of natural ivory, and thereafter mounting said piano key cover upon a key board base and assembling said piano.

7. The method of claim 12 wherein said filler comprises polyethylene glycol (PEG).

8. The method of claim 13 wherein said PEG filler has a particle size of about 1 micron.

9. The method of claim 6 wherein many of the pores comprising said plurality of fine pores have diameters generally in a range of 0.0002 to 0.0012 inch.

10. The method of claim 6 wherein said synthetic material is selected from a group consisting of silicone rubber (RTV), acrylic polymer, acetate polymer and epoxy.

* * * * *